US006761051B1

(12) United States Patent
Tsai

(10) Patent No.: US 6,761,051 B1
(45) Date of Patent: Jul. 13, 2004

(54) ELECTRIC PADLOCK

(75) Inventor: Hung-Cheng Tsai, Chia-Yi (TW)

(73) Assignee: EZ Trend Technology Co., Ltd., Chia-Yi (TW)

( * ) Notice: Subject to any disclaimer, the term of this patent is extended or adjusted under 35 U.S.C. 154(b) by 0 days.

(21) Appl. No.: 10/373,698

(22) Filed: Feb. 27, 2003

(51) Int. Cl.[7] ..... E05B 67/24

(52) U.S. Cl. ..... 70/38 B; 70/38 A; 70/63; 70/257; 70/279.1; 70/282

(58) Field of Search ..... 70/38 A, 38 B, 70/63, 257, 279.1, 280–282

(56) References Cited

U.S. PATENT DOCUMENTS

| | | | | | |
|---|---|---|---|---|---|
| 2,160,294 | A | * | 5/1939 | Soref | |
| 3,477,261 | A | | 11/1969 | Siana | |
| 3,797,004 | A | | 3/1974 | Muessel et al. | 70/DIG. 49 X |
| 3,979,931 | A | * | 9/1976 | Man | 70/38 A |
| 4,070,882 | A | | 1/1978 | Ruiz | 70/427 |
| 4,726,206 | A | | 2/1988 | Hsu | 70/441 |
| 5,195,342 | A | | 3/1993 | Werner | 70/417 |
| 5,372,019 | A | * | 12/1994 | Hsiao | 70/38 A |
| 5,561,996 | A | * | 10/1996 | Chang | 70/247 |
| 5,598,725 | A | | 2/1997 | Chang | 70/209 |
| 5,727,405 | A | * | 3/1998 | Cromwell | 70/38 B |
| 5,868,013 | A | * | 2/1999 | Julien | 70/38 A |
| 5,927,112 | A | | 7/1999 | Yamashita | 70/252 |
| 6,046,558 | A | * | 4/2000 | Larson et al. | 318/283 |
| 6,047,575 | A | * | 4/2000 | Larson et al. | 70/278.1 |
| 6,401,501 | B1 | * | 6/2002 | Kajuch et al. | 70/25 |
| 6,442,983 | B1 | * | 9/2002 | Thomas et al. | 70/38 A |
| 6,517,127 | B1 | * | 2/2003 | Lu et al. | 292/144 |
| 6,585,302 | B2 | * | 7/2003 | Lin | 292/142 |
| 6,591,643 | B1 | * | 7/2003 | Cannella et al. | 70/277 |
| 6,598,439 | B1 | | 7/2003 | Chen | 70/423 |

* cited by examiner

*Primary Examiner*—Lloyd A. Gall
(74) *Attorney, Agent, or Firm*—Baker Botts L.L.P.

(57) ABSTRACT

In an electric padlock, a lock casing is formed with first and second shackle insert holes. A shackle member has a longer leg portion that is movably disposed in the second shackle insert hole and that is biased upwardly. A latch member is received in the lock casing, and is movable between locking and unlocking positions for engaging and disengaging a shackle groove in a shorter leg portion of the shackle member. An electric operating unit includes a drive motor mounted in the lock casing and engaging the latch member. The drive motor is operable for moving the latch member from the locking position to the unlocking position. A remote controller is operable so as to provide an electric signal to the drive motor for controlling operation of the drive motor.

9 Claims, 9 Drawing Sheets

ELECTRIC PADLOCK

BACKGROUND OF THE INVENTION

1. Field of the Invention

The present invention relates to a padlock, more particularly to an electric padlock which can be operated electrically with the use of a remote controller to provide added user convenience.

2. Description of the Related Art

A conventional padlock typically includes a lock body with a lock core device mounted therein, and a U-shaped shackle member mounted on the lock body for hooking at objects to be locked. The shackle member is movable between locking and unlocking positions by operating the lock core device with the use of a corresponding key. However, in certain circumstances, insertion of the key into a keyhole of the lock core device might be difficult or inconvenient to conduct. It is thus desirable to provide a padlock that can be operated in a more convenient manner to result in enhanced user convenience.

SUMMARY OF THE INVENTION

Therefore, the object of the present invention is to provide a padlock which can be operated electrically. Accordingly, the electric padlock of the present invention includes a lock casing, an inverted U-shaped shackle member, a biasing spring, a latch member, and an electric operating unit. The lock casing has a top wall formed with first and second shackle insert holes. The shackle member has a longer leg portion movably disposed in the second shackle insert hole, and a shorter leg portion parallel to the longer leg portion and extendible into the first shackle insert hole. The shorter leg portion is formed with a shackle groove. The biasing spring is mounted in the second shackle insert hole for biasing the longer leg portion upwardly. The latch member is received in the lock casing, and is movable between a locking position in which the latch member is moved toward the first shackle insert hole for engaging the shackle groove in the shorter leg portion of the shackle member when the shorter leg portion is inserted into the first shackle insert hole so as to lock the shackle member on the lock casing, and an unlocking position in which the latch member is moved away from the first shackle insert hole for disengaging from the shackle groove to permit upward movement of the shorter leg portion by virtue of biasing action of the biasing spring so as to unlock the shackle member from the lock casing. The electric operating unit includes a drive motor and a remote controller. The drive motor is mounted in the lock casing, engages the latch member, and is operable for moving the latch member from the locking position to the unlocking position. The remote controller is operable so as to provide an electric signal to the drive motor for controlling operation of the drive motor.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
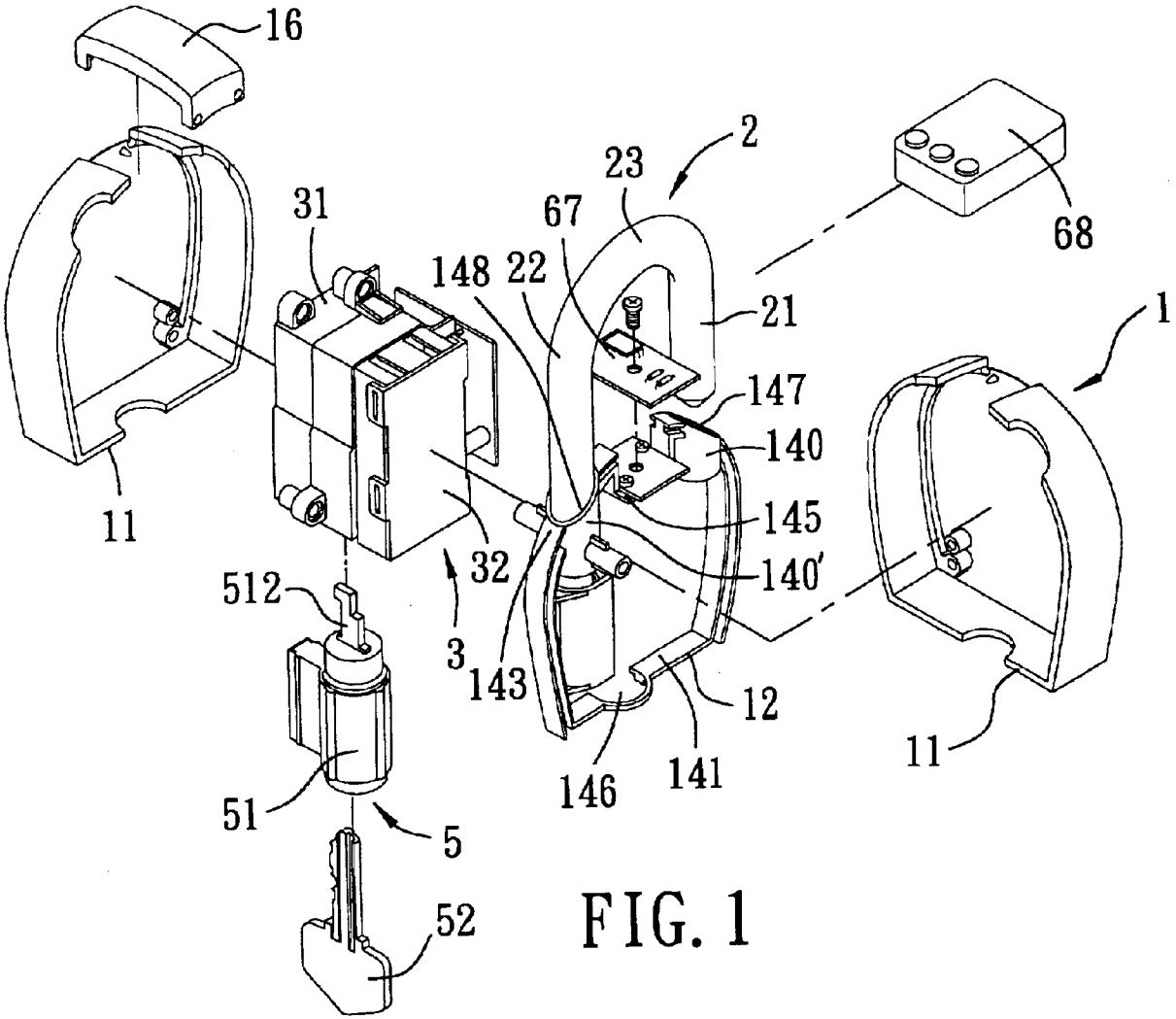
FIG. 1 is a partly exploded perspective view illustrating a first preferred embodiment of the electric padlock of the present invention.
Figure 2:
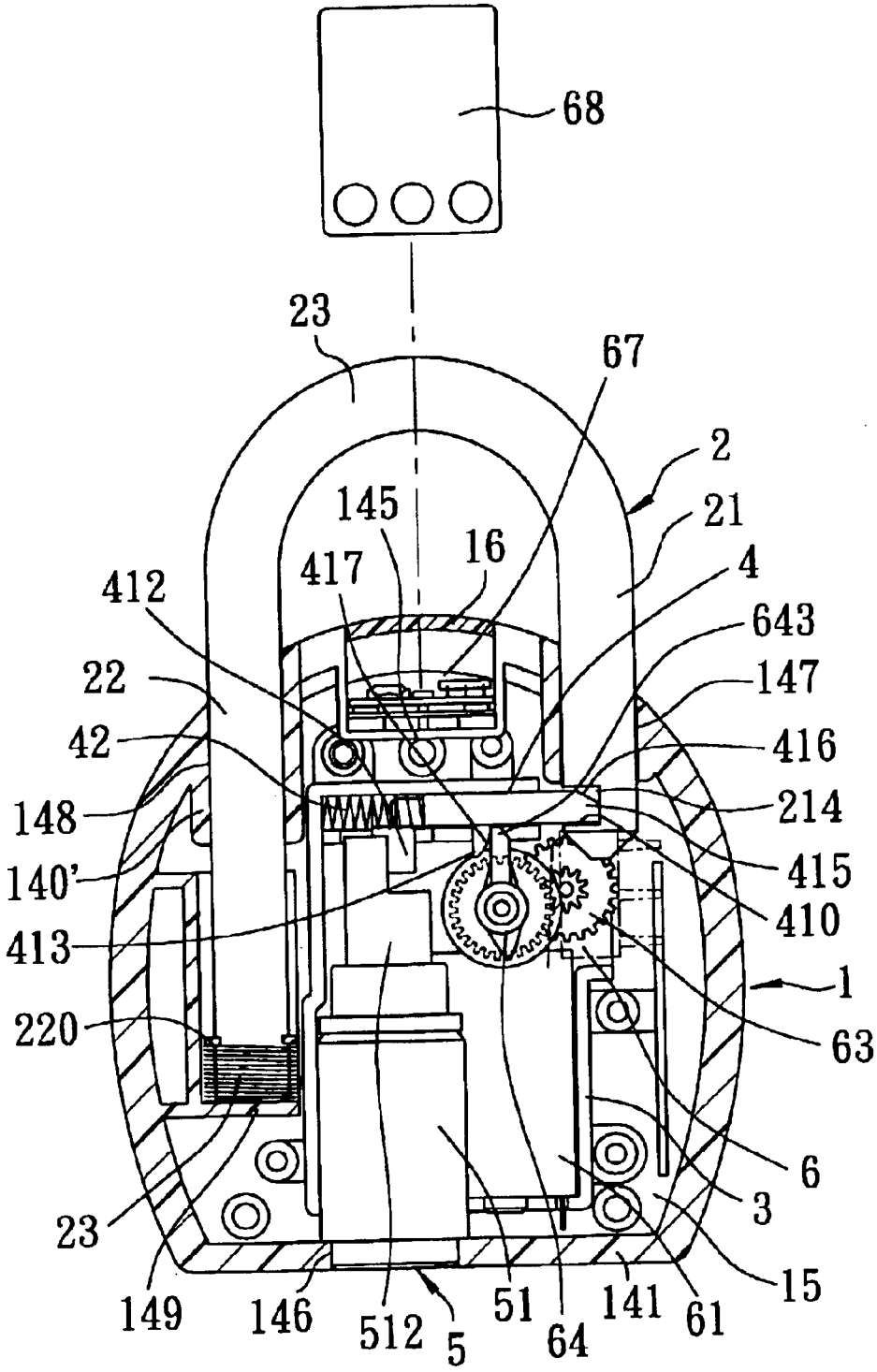
FIG. 2 is a sectional view of the first preferred embodiment in a locked state.

Referring to FIGS. 1 and 2, the first preferred embodiment of the electric padlock of the present invention is shown to mainly include a lock casing with inner and outer casing members 1, 3, a shackle member 2, a latch member 4, a key-operated lock unit 5, and an electric operating unit 6.

The outer casing 1 is composed of front and rear casing parts 11, and an intermediate casing part 12 secured to and interconnecting the front and rear casing parts 11. The front, rear and intermediate casing parts 11, 12 cooperatively confine a receiving space 15. The intermediate casing part 12 has a top wall 143 formed with first and second shackle insert holes 147, 148, and a bottom wall 141 formed with a key insert hole 146. Each of the first and second shackle insert holes 147, 148 is defined by a tubular wall 140, 140' that extends downwardly from the topwall 143 into the receiving space 15. Between the first and second shackle insert holes 147, 148, there is a flat indented portion 145 of the top wall 143.

The shackle member 2 is generally inverted U-shaped, and has a longer leg portion 22, a shorter leg portion 21 parallel to the longer leg portion 22, and a curved connecting portion 23 interconnecting upper ends of the longer and shorter leg portions 22, 21. The longer leg portion 22 is mounted rotatably and is movably disposed in the second shackle insert hole 148. A first biasing spring 23, in the form of a compression spring, is received in the second shackle insert hole 148 and is sleeved on a lower end of the longer leg portion 22. The first biasing spring 23 abuts against a bottom wall 149 of the second shackle insert hole 148, and a retaining ring 220 on the longer leg portion 22 so as to apply an upward biasing force for biasing the longer leg portion 22, and thus the shackle member 2, to move upwardly. The retaining ring 220 abuts against a lower edge of the tubular wall 140' when the longer leg portion 22 springs upwardly, thereby preventing removal of the longer leg portion 22 from the lock casing. The shorter leg portion 21 is extendible into the first shackle insert hole 147, and is formed with a first shackle groove 214.

Figure 3:
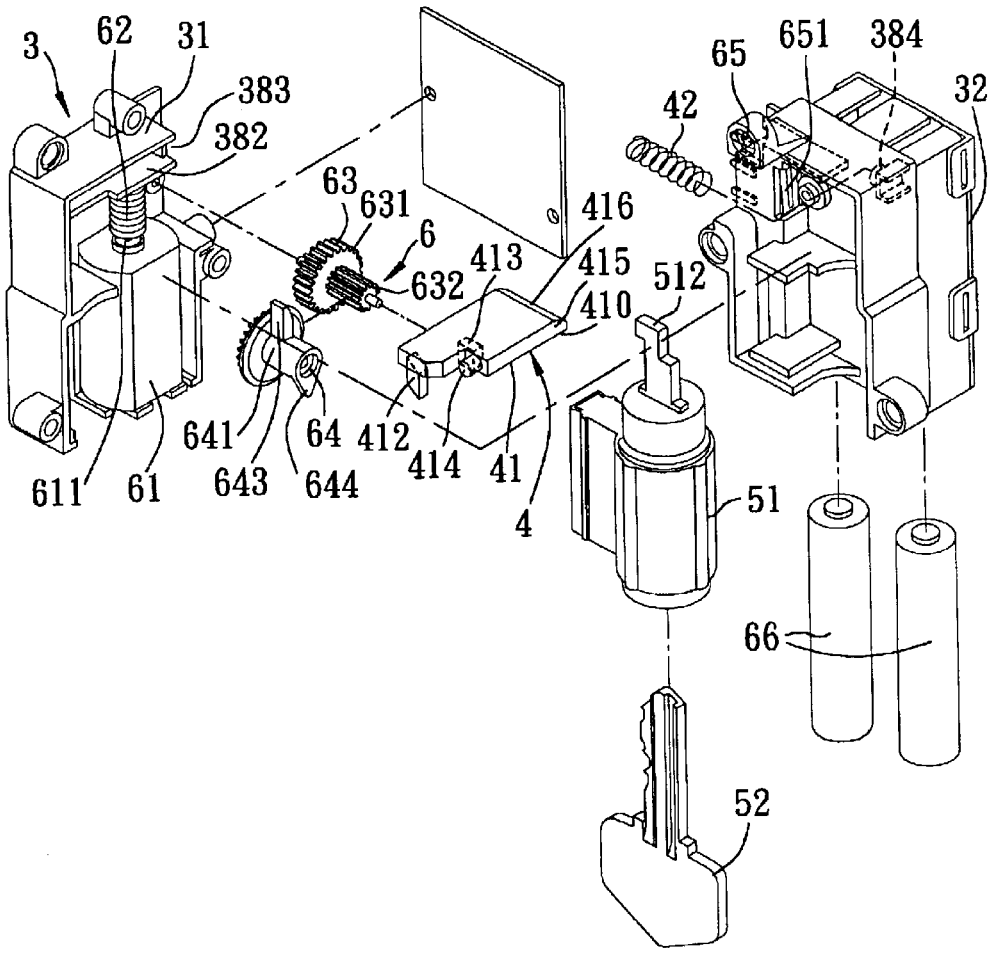
FIG. 3 is another exploded perspective view of the first preferred embodiment of the present invention, with an outer casing removed for the sake of clarity.

With further reference to FIG. 3, the inner casing member 3 includes front and rear casing parts 31, 32, and is mounted fixedly within the receiving space 15 of the outer casing member 1. The inner casing member 3 is formed with a horizontally extending slide channel 382 with an open end 383, for receiving the latch member 4, A second biasing spring 42, in the form of a compression spring, is mounted in the inner casing member 3, and is retained between a first spring retaining stud 384 formed on an inner side wall of the inner casing member 3 and a second spring retaining stud 414 formed on a spring mounting end of the latch member 4 so as to apply a biasing force to the latch member 4 to move the latch member 4 along the slide channel 382 to a locking position, in which the latch member 4 projects from the open end 383 of the slide channel 382 and is moved toward the first shackle insert hole 147 for engaging the first shackle groove 214 when the shorter leg portion 21 is extended into the first shackle insert hole 147, thereby locking the shackle member 2 on the lock casing. The latch member 4 is in the form of a flat plate body 41 with a bottom side surface 410 formed with first and second operating projections 413, 412. The latch member 4 further has a shackle engaging end 415 opposite to the spring mounting end for engaging the shackle member 2. The shackle engaging end 415 has a tapered wall 416 that faces upwardly. The first operating projection 413 has a convex face 417 confronting the first shackle insert hole 147.

The electric operating unit 6 includes a drive motor 61, a worm gear 62, a transmission gear 63, an operating gear 64, a receiver unit 67 (see FIG. 1), and a remote controller 68. The drive motor 61 is mounted in the inner casing member 3, and has a rotary transmission shaft 611 with the worm gear 62 sleeved securely thereon. The transmission gear 63 is mounted rotatably in the inner casing member 3. In the present embodiment, the transmission gear 63 is a speed reducing gear with a first gear portion 631 engaging the worm gear 62 and a second gear portion 632 engaging a circular gear plate portion 642 of the operating gear 64. The operating gear 64 further has a cylindrical mounting portion 641 which has one end secured to the gear plate portion 642 and which is coaxial with the gear plate portion 642. The cylindrical mounting portion 641 is mounted rotatably in the inner casing member 3, and is formed with a radial cam projection 643 and a radial switch actuating projection 644 angularly displaced from the radial cam projection 643. A switch member 65 is mounted in the inner casing member 3, and is connected electrically to the drive motor 61 for controlling deactivation of the drive motor 61. An electric power source, such as a battery set 66, is received removably in the inner casing member 3 and is connected electrically to the drive motor 61 for providing electric power to the drive motor 61. The remote controller 68 is operable so as to provide an electric signal to the receiver unit 67, which is mounted on the indented portion 145 of the top wall 143 of the outer casing member 1 and which is covered by a transparent cover plate 16. The receiver unit 67 enables operation of the drive motor 61 in response to the electric signal received from the remote controller 68. When the drive motor 61 is operated, rotation of the transmission shaft 611 is transmitted to the operating gear 64 through the worm gear 62 and the transmission gear 63. At this time, the radial cam projection 643 rotates with the operating gear 64, and engages the first operating projection 413 on the latch member 4 at the convex face 417 of the first operating projection 413 to move the latch member 4 from the locking position to an unlocking position, in which the latch member 4 is moved away from the first shackle insert hole 147 for disengaging from the first shackle groove 214 in the shorter leg portion 21 of the shackle member 2, thereby permitting removal of the shorter leg portion 21 from the lock casing by virtue of the biasing action of the first biasing spring 23, thus unlocking the shackle member 2 from the lock casing. After the drive motor 61 is operated to rotate the operating gear 64 by a predetermined angle, the radial cam projection 643 disengages from the first operating projection 413 of the latch member 41 to enable the latch member 4 to move from the unlocking position back to the locking position by virtue of biasing action of the second biasing spring 42. The switch actuating projection 644 is rotated with the operating gear 64 toward the switch member 65 during operation of the drive motor 61, and actuates a switch contact 651 of the switch member 65 to cause the switch unit 65 to deactivate the drive motor 61 when the shorter leg portion 21 is removed from the lock casing.

The lock unit 5 includes a lock core device 51 with a latch actuator 512, and a key 52 which is insertable into the lock core device 51 for rotating the latch actuator 512. The latch actuator 512 engages the second operating projection 412. When the lock core device 51 is operated by the key 52, the latch actuator 512 engages the second operating projection 412 to move the latch member 4 from the locking position to the unlocking position against biasing action of the second biasing spring 42.

Figure 4:
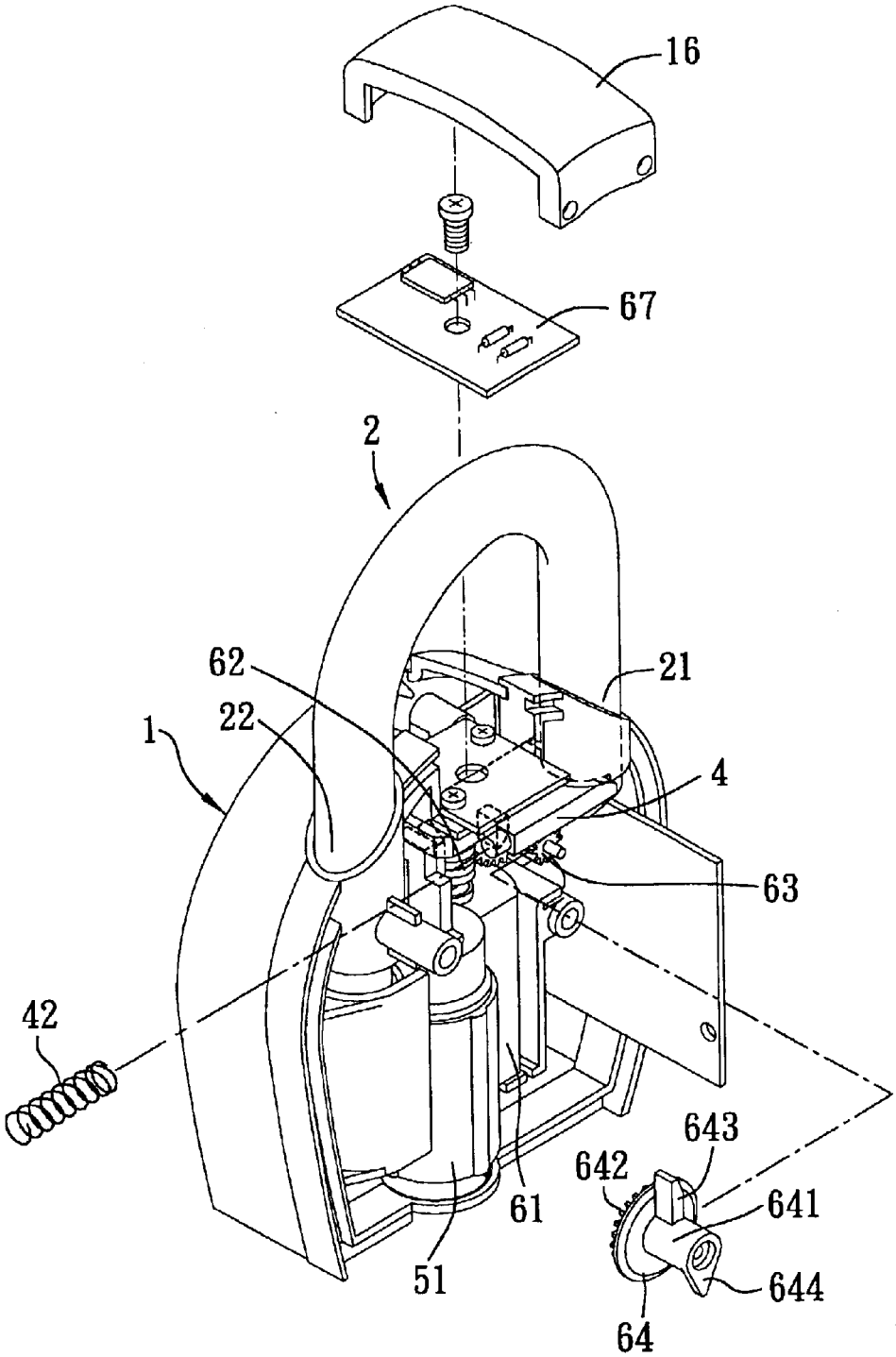
FIG. 4. is another partly exploded perspective view of the first preferred embodiment of the present invention.

Referring to FIGS. 2 and 4, when the padlock is in a locked state, the shorter leg portion 21 of the shackle member 2 is received in the first shackle insert hole 147 and engages the shackle engaging end 415 of the latch member 4. At this time, the first biasing spring 23 is compressed, while the second biasing spring 42 expands.

Figure 6:
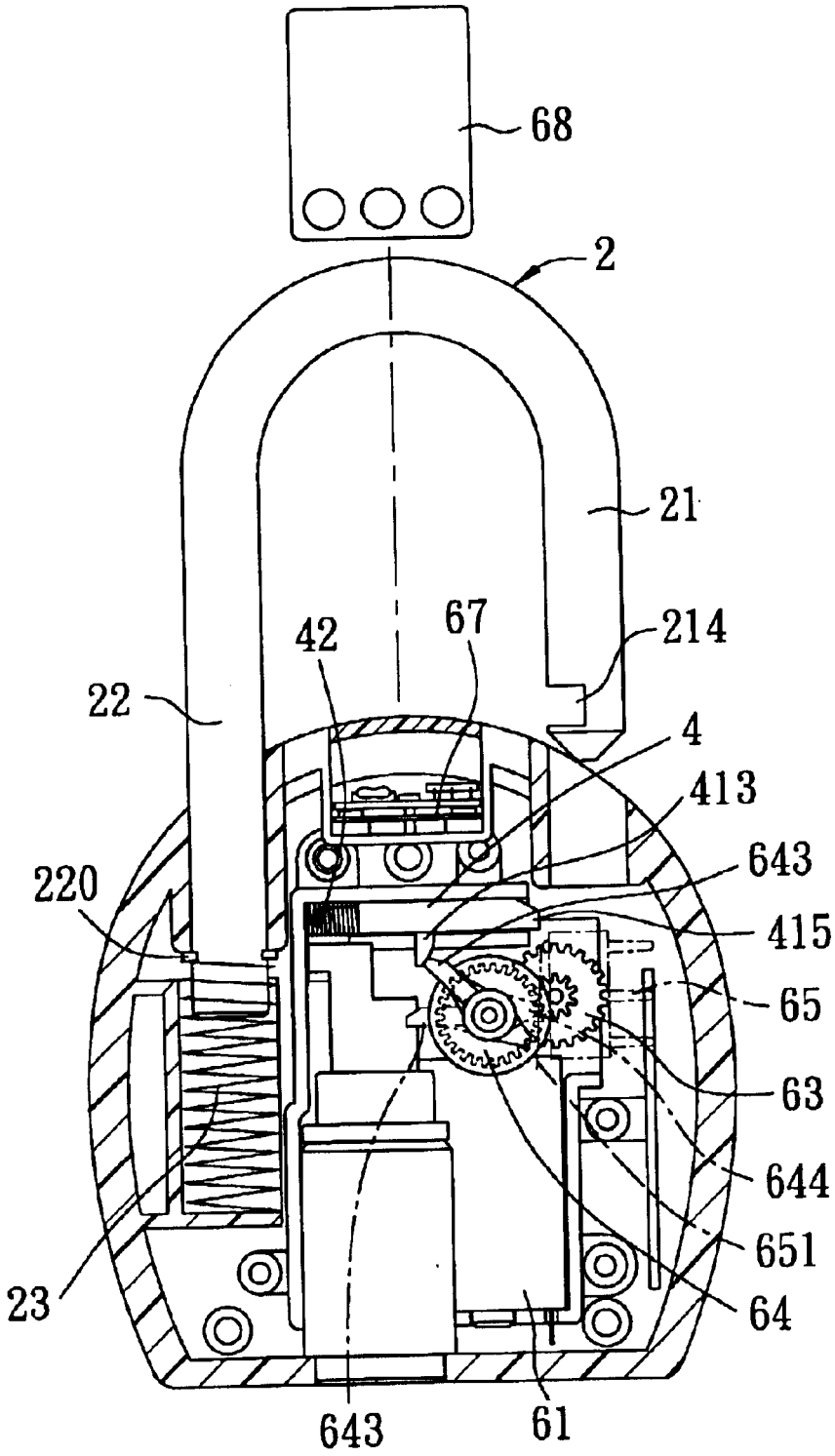
FIG. 6 is another sectional view of the first preferred embodiment, illustrating operation for unlocking the padlock with the use of a remote controller.

Referring to FIGS. 2, 3 and 6, to unlock the padlock through operation of the electric operating unit 6, the remote controller 68 is operated to provide an electric signal to the receiver unit 67, which, in turn, activates the drive motor 61 so as to drive rotation of the operating gear 64. When the operating gear 64 is rotated, the radial cam projection 643 is rotated to engage the first operating projection 413 on the latch member 4 and move the latch member 4 to the unlocking position, thereby compressing the second biasing spring 42 and thereby disengaging the latch member 4 from the first shackle groove 214 of the shorter leg portion 21 of the shackle member 2. At this time, the entire shackle member 2 springs upwardly due to expansion of the first biasing spring 23. The shorter leg portion 21 is thus removed from the lock casing, and the padlock is thereby unlocked. Thereafter, the drive motor 61 will be deactivated when the switch actuating projection 644 has moved to a position for actuating the switch contact 651 of the switch member 65.

Figure 5:
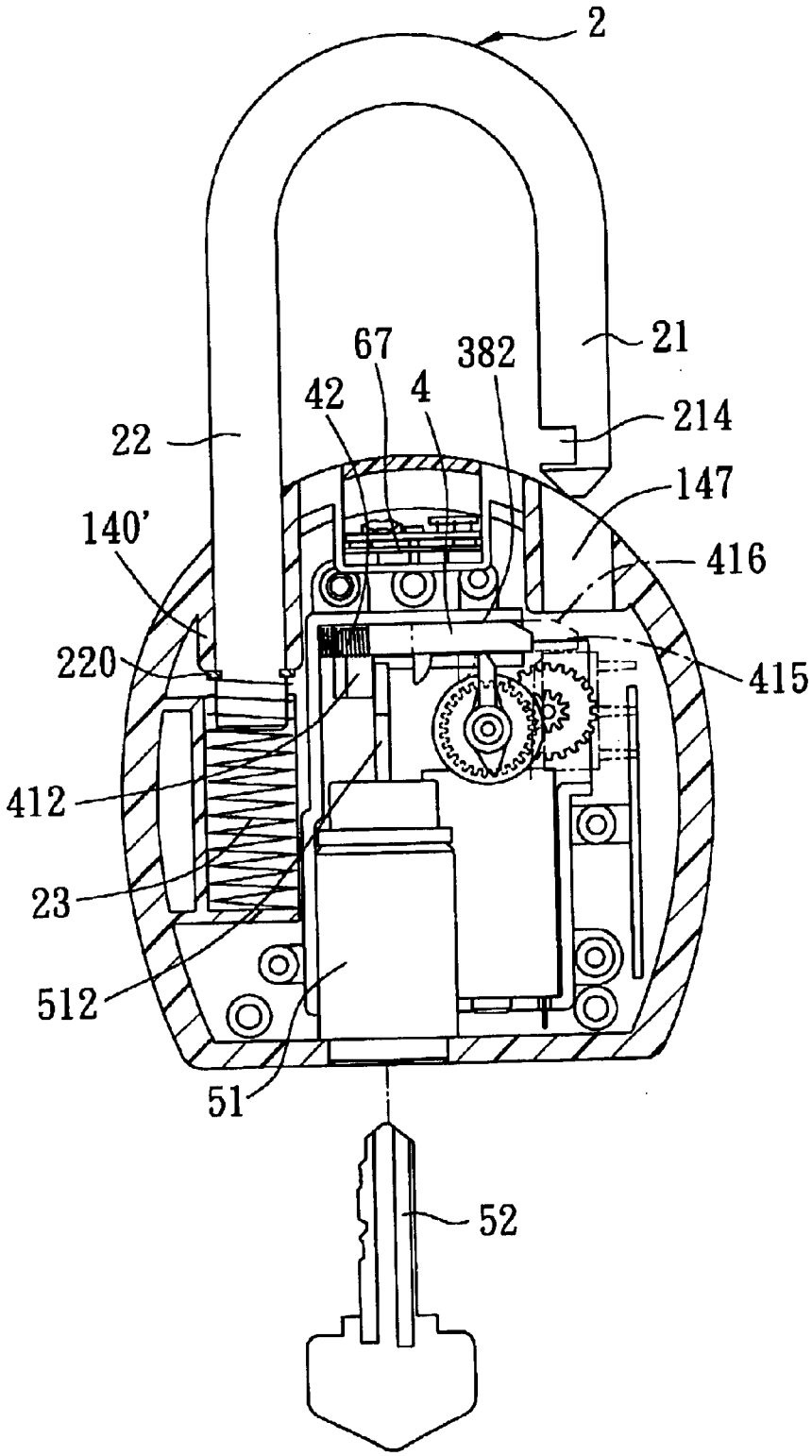
FIG. 5 is a sectional view of the first preferred embodiment, illustrating operation for unlocking the padlock with the use of a key.

Referring to FIG. 5, on the other hand, when it is desired to unlock the padlock through manual operation, the key 52 is inserted into the lock core device 51 and is operated to rotate the latch actuator 512 in a known manner so as to enable the latch actuator 512 to push the second operating projection 412. Accordingly, the latch member 4 will be moved to the unlocking position for disengaging from the first shackle groove 214 of the shorter leg portion 21 of the shackle member 2.

To once again place the padlock in the locked state, the shorter leg portion 21 is simply aligned with the first shackle insert hole 147 and is depressed so as to be inserted into the first shackle insert hole 147.

At this time, the lower end of the shorter leg portion 21 slides past the tapered wall 416 on the latch engaging end 415 of the latch member 4 and pushes the latch member 4 in a direction away from the first shackle insert hole 147 to compress the second biasing spring 42. When the first shackle groove 214 is aligned with the latch member 4 during insertion of the shorter leg portion 21, the latch member 4 will be moved to the locking position, due to expansion of the second biasing spring 42, to engage the shorter leg portion 21, thereby locking the padlock.

Figure 7:
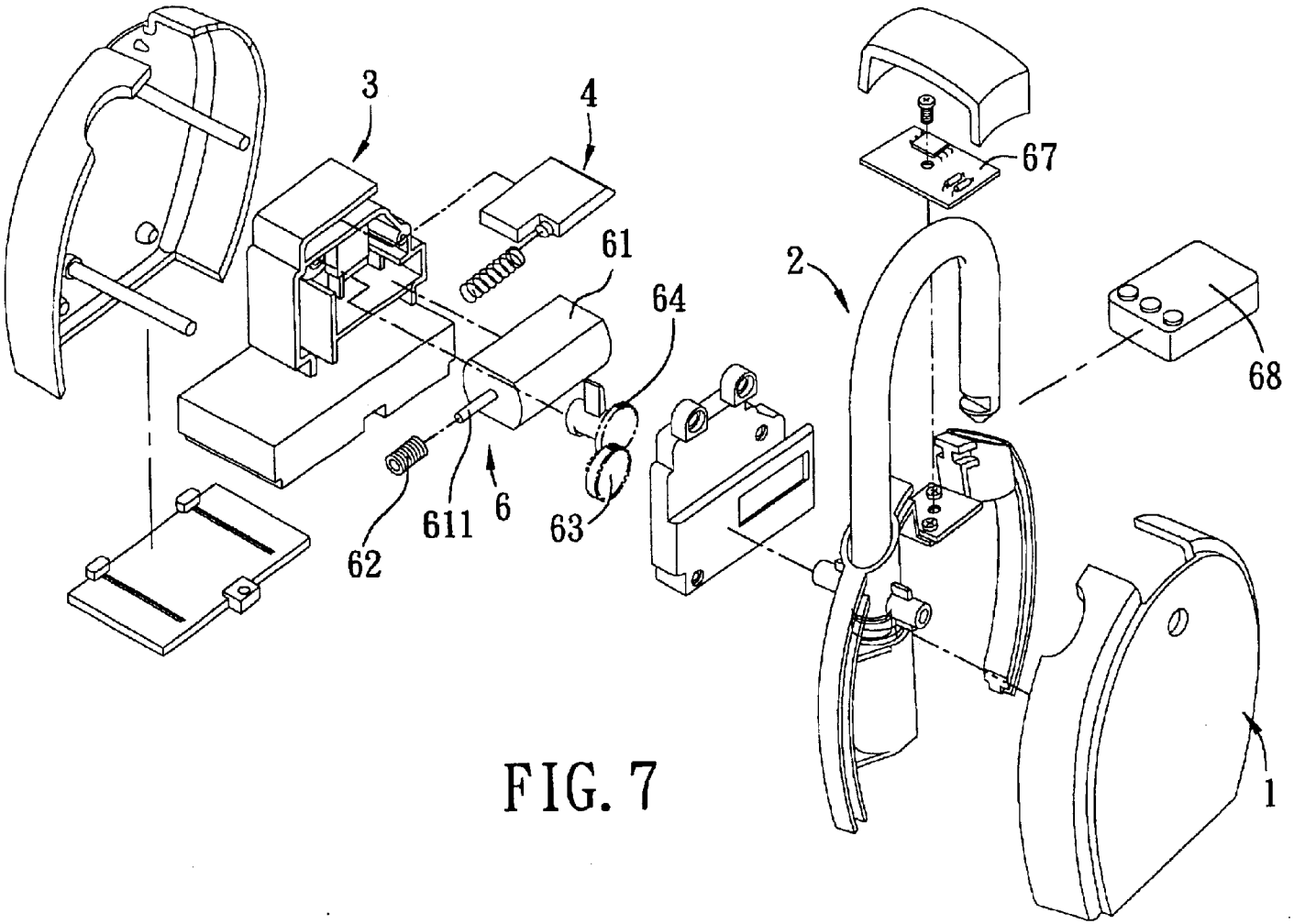
FIG. 7 is an exploded perspective view of a second preferred embodiment of the electric padlock of the present invention.
Figure 8:
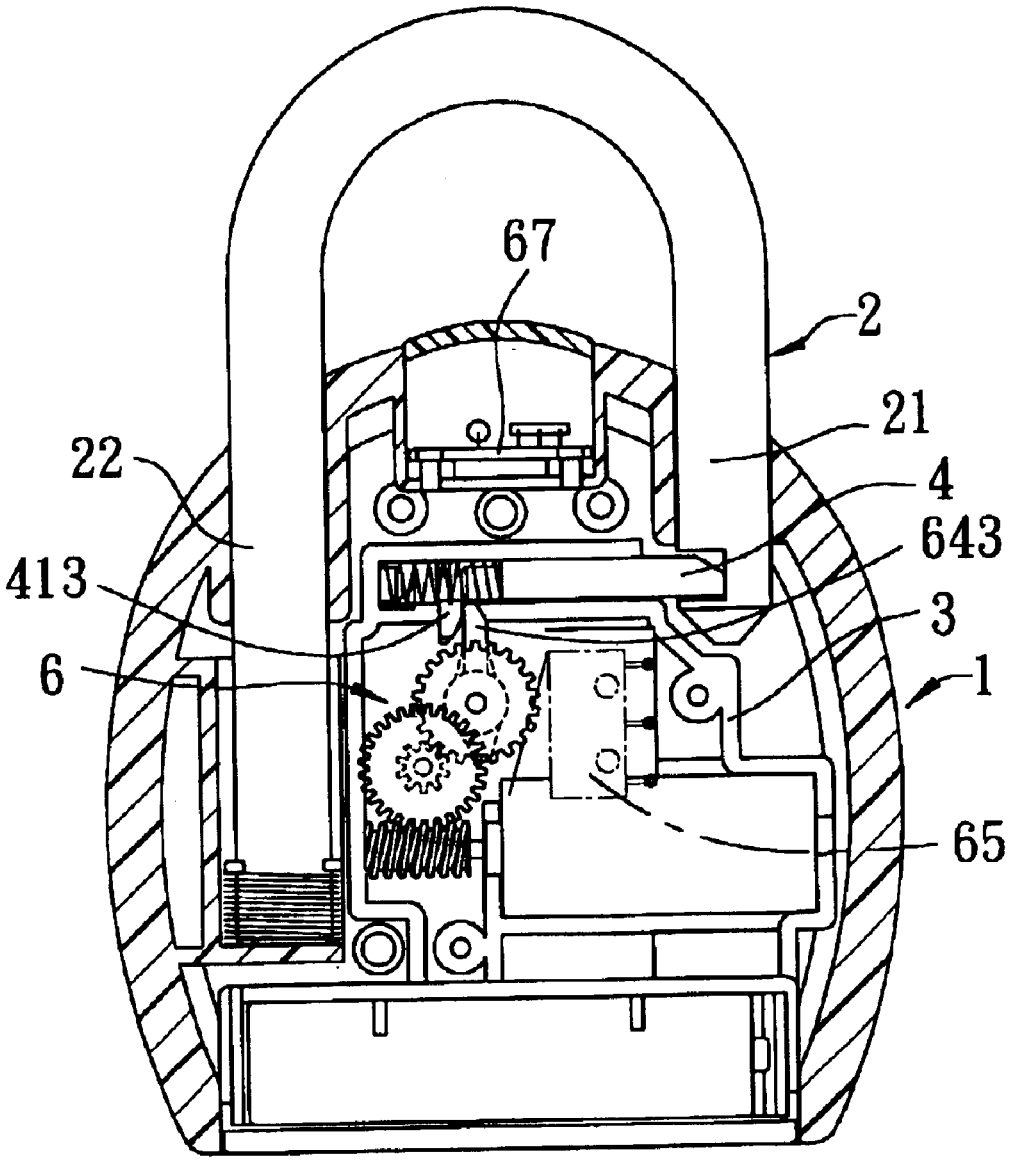
FIG. 8 is a sectional view of the second preferred embodiment.

Referring to FIGS. 7 and 8, the second preferred embodiment of the electric padlock according to the present invention is generally similar to the previous embodiment, except that a key-operated lock unit is not provided. The electric padlock of the present embodiment is operable electrically with the use of the remote controller 68 for unlocking.

Figure 9:
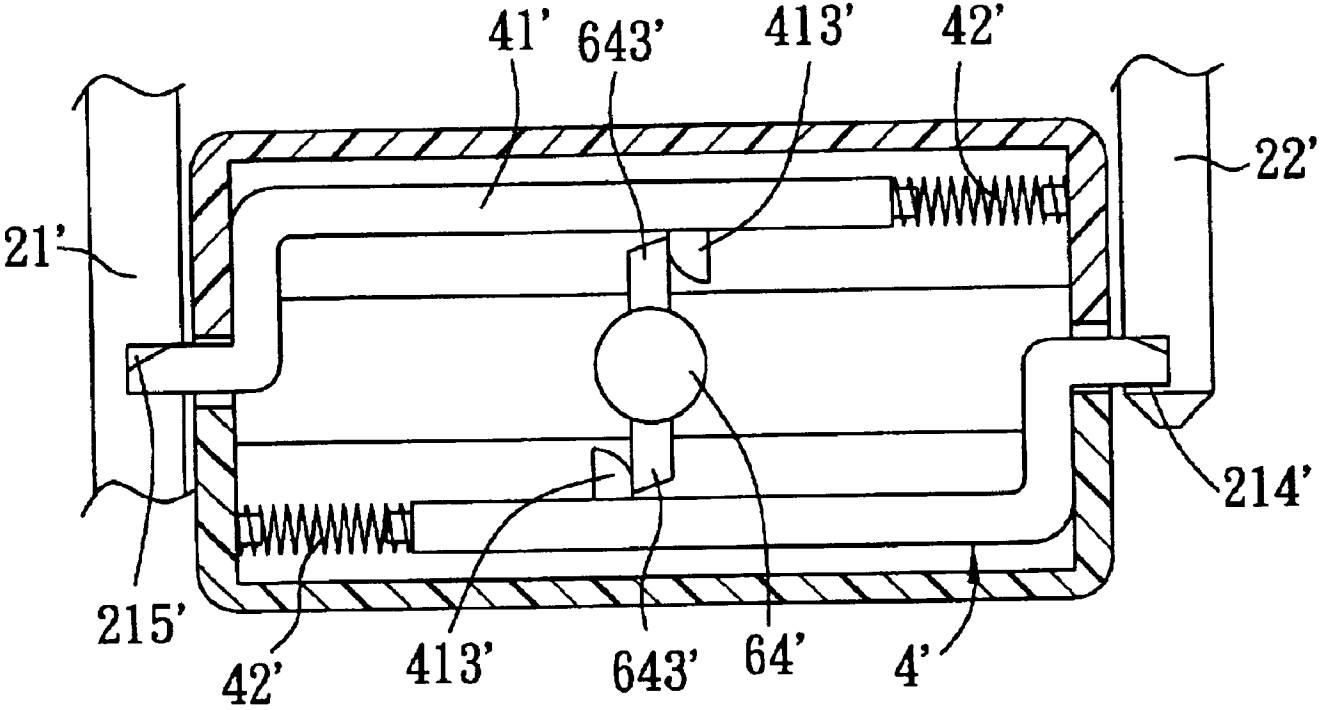
FIG. 9 is a fragmentary sectional view illustrating a third preferred embodiment of the electric padlock of the present invention.

Referring to FIG. 9, in the third preferred embodiment of the electric padlock according to the present invention, first and second latch members 4', 41' are provided in the lock casing. Each of the first and second latch members 4', 41' is formed with an operating projection 413', and is biased by a respective compression spring 42' for moving to a locking position, in which the first and second latch members 4' , 41' engage first and second shackle grooves 214', 215' in the shorter and longer leg portions 21', 22' of the shackle member, respectively. The operating gear 64' is formed with first and second radial cam projections 643' which are diametrically opposite to each other with respect to a rotary axis of the operating gear 64'. When the operating gear 64' is rotated, the first and second radial cam projections 643' engage the operating projections 413' respectively to retract the first and second latch members 4', 41' and to move the first and second latch members 4', 41' to the unlocking position for disengaging from the shorter and longer leg portions 21', 22' of the shackle member.

It has thus been shown that the padlock of the present invention can be operated electrically, with the use of a remote controller. Added conveniences can thus be attained.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electric padlock comprising:

a lock casing having a top wall with first and second shackle insert holes formed therein;

an inverted U-shaped shackle member having a longer leg portion movably disposed in said second shackle insert hole, and a shorter leg portion parallel to said longer leg portion and extendible into said first shackle insert hole, said shorter leg portion being formed with a shackle groove formed therein;

a first biasing spring mounted in said second shackle insert hole for biasing said longer leg portion upwardly;

a latch member received in said lock casing and movable between a locking position in which said latch member is moved toward said first shackle insert hole for engaging said shackle groove in said shorter leg portion of said shackle member when said shorter leg portion is inserted into said first shackle insert hole so as to lock said shackle member on said lock casing, and an unlocking position in which said latch member is moved away from said first shackle insert hole for disengaging from said shackle groove to permit upward movement of said shorter leg portion by virtue of biasing action of said first biasing spring so as to unlock said shackle member from said lock casing;

a key-operated lock unit received in said lock casing, said lock unit including a lock core device with a latch actuator, and a key which is insertable into said lock core device for operating said latch actuator, said latch actuator engaging said latch member and moving said latch member from said locking position to said unlocking position when said key is operated; and an electric operating unit including a drive motor mounted in said lock casing and operable for moving said latch member from said locking position to said unlocking position, and a remote controller which is operable to provide an electric signal to said drive motor for controlling operation of said drive motor; said lock core device and a rotary transmission shaft of said drive motor being disposed parallel to each other and being adjacent to a same side surface of said latch member.

2. The electric padlock as claimed in claim 1, wherein said latch member is formed with first and second operating projections;

said electric operating unit further including an operating gear mounted rotatably in said lock casing and coupled to said drive motor, said operating gear being formed with a radial cam projection which engages said first operating projection for moving said latch member from said locking position to said unlocking position when said drive motor is operated, and which disengages from said first operating projection after said drive motor is operated to rotate said operating gear by a predetermined angle;

said latch actuator of said lock core device engaging said second operating projection for moving said latch member from said locking position to said unlocking position when said key is operated;

said electric padlock further comprising a switch member mounted in said lock casing and connected electrically to said drive motor, said operating gear being further formed with a radial switch actuating projection which is rotatable with said operating gear toward said switch member so as to actuate said switch member and cause said switch member to deactivate said drive motor when said shorter leg portion is removed from said lock casing.

3. The electric padlock as claimed in claim 2, wherein said electric operating unit further including a worm gear sleeved on and secured to said transmission shaft, and a transmission gear engaging said worm gear and said operating gear for transmitting rotation of said worm gear to said operating gear;

said operating gear including a cylindrical mounting portion mounted rotatably in said lock casing, and a circular gear plate portion coaxial with said cylindrical mounting portion and secured to one end of said cylindrical mounting portion, said gear plate portion engaging said transmission gear, said cylindrical mounting portion being formed with said radial cam projection and said radial switch actuating projection that are angularly displaced from each other.

4. The electric padlock as claimed in claim 3, wherein said transmission gear is a speed-reducing gear.

5. The electric padlock as claimed in claim 2, wherein said first and second operating projections are formed on said same side surface of said latch member.

6. The electric padlock as claimed in claim 2, further comprising a second biasing spring disposed in said lock casing and biasing said latch member to said locking position such, that said latch member is movable from said unlocking position back to said locking position when said radial cam projection disengages from said first operating projection.

7. The electric padlock as claimed in claim 6, wherein said latch member has a shackle engaging end disposed proximate to said first shackle insert hole for engaging said shackle groove in said shorter leg portion of said shackle member, and a spring mounting end opposite to said shackle engaging end and acted upon by said second biasing spring, said shackle engaging end having a tapered wall that faces upwardly, said shorter leg portion sliding past said tapered wall and pushing said latch member in a direction away from said first shackle insert hole against biasing action of said second biasing spring when said shorter leg portion is inserted into said first shackle insert hole, said latch member being moved to said locking position by virtue of biasing action of said second biasing spring when said shackle groove in said shorter leg portion is registered with said latch member upon insertion of said shorter leg portion into said first shackle insert hole.

8. The electric padlock as claimed in claim 1, wherein said electric operating unit further includes a receiver unit mounted on said lock casing and connected electrically to said drive motor, said receiver unit receiving the electric signal and enabling operation of said drive motor in response to the electric signal.

9. The electric padlock as claimed in claim 1, wherein said lock casing includes an outer casing member formed with said first and second shackle insert holes, and an inner casing member received in said outer casing member, said drive motor and said latch member being mounted in said inner casing member.

* * * * *